US011542753B2

(12) United States Patent
Tian et al.

(10) Patent No.: US 11,542,753 B2
(45) Date of Patent: Jan. 3, 2023

(54) MECHANICAL ROTARY STEERING DRILLING TOOL

(71) Applicants: Southwest Petroleum University, Chengdu (CN); Sichuan Jutingzao Technology Co., Ltd., Chengdu (CN)

(72) Inventors: Jialin Tian, Chengdu (CN); Zhichao Hu, Chengdu (CN); Tongxu Ge, Chengdu (CN); Lin Yang, Chengdu (CN); Chunyu Xing, Chengdu (CN); Lei Tang, Chengdu (CN)

(73) Assignees: Southwest Petroleum University, Chengdu (CN); Sichuan Jutingzao Technology Co., Ltd., Chengdu (CN)

( * ) Notice: Subject to any disclaimer, the term of this patent is extended or adjusted under 35 U.S.C. 154(b) by 39 days.

(21) Appl. No.: 17/335,773

(22) Filed: Jun. 1, 2021

(65) Prior Publication Data

US 2022/0186563 A1 Jun. 16, 2022

(30) Foreign Application Priority Data

Dec. 10, 2020 (CN) ..... 202011454341.8

(51) Int. Cl.
*E21B 7/06* (2006.01)
*E21B 17/10* (2006.01)
*E21B 47/022* (2012.01)

(52) U.S. Cl.
CPC ..... *E21B 7/067* (2013.01); *E21B 7/062* (2013.01); *E21B 17/1021* (2013.01); *E21B 47/022* (2013.01)

(58) Field of Classification Search
CPC ..... E21B 7/067; E21B 7/062; E21B 17/1021
See application file for complete search history.

(56) References Cited

U.S. PATENT DOCUMENTS 6,328,119 B1 * 12/2001 Gillis ..... E21B 7/062 175/325.1
2015/0101864 A1 * 4/2015 May ..... E21B 44/00 175/27
2017/0234071 A1 * 8/2017 Spatz ..... E21B 10/567 175/61
2020/0190909 A1 * 6/2020 Liu ..... E21B 7/067

FOREIGN PATENT DOCUMENTS

CN 110043188 A * 7/2019 ..... E21B 4/04
CN 110067510 A * 7/2019 ..... E21B 7/04

* cited by examiner

*Primary Examiner* — Robert E Fuller
*Assistant Examiner* — Theodore N Yao
(74) *Attorney, Agent, or Firm* — Andrew D. Fortney; Central California IP Group, P.C.

(57) ABSTRACT

A mechanical rotary steering drilling tool for steering a drill string includes a test section, a clutch device, a control mechanism, and an execution part. The test section is used as an upper joint in cooperation with the tool. The clutch device is externally connected with a guide body and internally coupled with a mandrel. A groove on a cylindrical surface of a switch control cylinder is matched with a control screw to determine rotation of a fluid channel switch. A pushing block of the execution part extends out against a wellbore wall to push a drill bit for steering drilling after the fluid channel is opened.

10 Claims, 3 Drawing Sheets

MECHANICAL ROTARY STEERING DRILLING TOOL

TECHNICAL FIELD

Embodiments disclosed herein relate to the technical field of petroleum drilling. More specifically, embodiments disclosed herein relate to a mechanical rotary steering drilling tool.

BACKGROUND

The demand for oil and gas is increasing as a result of economic development, with the depletion of global oil and gas resources of shallow layer recently. Oil and gas resources in the shallow layer are unable to satisfy the expanding needs, which demand drilling technology to develop in the direction of special process wells such as deep wells, ultra-deep wells, long distance and horizontal wells. Compared with conventional wells, the wells with special operation process can obtain larger oil and gas reservoir, by improving oil output and reducing costs. Considering economic factors, a rotary steering drilling method is used in special process wells to flexibly adjust the well inclination and azimuth, which obviously improves the drilling speed, guarantees drilling safety, and enhances the accuracy of the well trajectory. Rotary steering tools are very suitable for the development of special process wells due to increasing drilling speed, reducing or even avoiding drilling accidents, and effectively decreasing drilling costs. However, existing rotary steerable drilling systems are expensive and unreliable due to the presence of electronic equipment.

Therefore, achieving the directional drilling of the well trajectory quickly and efficiently at the lower cost is a technical problem that is urgently needed by engineering field.

SUMMARY OF THE INVENTION

Embodiments disclosed herein relate to a mechanical rotary steering drilling tool controlled by a mechanical structure for drilling, including a test section, a mandrel having a keyway, a clutch device, a guide body, a control mechanism, an execution part, a plane bearing, and a tungsten carbide (TC) bearing.

The test section is connected with the mandrel by a threaded screw-type fitting, serves as the upper joint of the mechanical rotary steering drilling tool, and is configured to test an azimuth angle, a tool face angle and a well inclination angle, and to transmit relevant test data to the ground.

The clutch device includes a spring retainer axially positioned by a TC bearing static ring, a clutch key in the keyway of the mandrel, a clutch key fixing screw that fixes the clutch key, a clutch control barrel connecting the mandrel and the guide body, and a clutch spring between the spring retainer and the clutch key. The mandrel and the guide body rotate independently of each other when the clutch device is disengaged, but the mandrel and the guide body rotate together when the clutch device is engaged.

The control mechanism includes a switch control cylinder that converts axial movement into rotational movement, a screw on the guide body configured to limit an axial displacement of the switch control cylinder, a control spring that drives the switch control cylinder, a thrust bearing that prevents the switch control cylinder from being driven by the control spring, and a switch driven by the switch control cylinder and configured to open or close the holes D.

The execution part includes a plurality of pushing blocks assembled in the cavities A of the guide body, a plurality of cover plates configured to limit a radial stroke of the pushing blocks, a plurality of cover plate screws configured to fix the cover plates, and a plurality of push block one-way nozzle configured to allow single direction communication; wherein, the pushing blocks are configured to exert a pushing force on an external wall.

In one embodiment, the clutch control cylinder has four evenly distributed splines corresponding to the keyways configured inside the guide body. The clutch control cylinder is clearance fit with the mandrel and the splines of the clutch control cylinder is clearance fit with the keyways of the guide body; further, the clutch control cylinder is configured to slide in an axial direction and the clutch spring has a maximum compression stroke greater than a length of the clutch key.

In some embodiments, there is only one clutch key configured, and the clutch key has ends that are arc surfaces; a keyway inside the clutch control cylinder corresponds to and/or matches the clutch key; four evenly distributed splines are configured on the external wall the spring retainer, and the guide body is configured with the keyways corresponding to the splines on the spring retainer; the spring retainer is configured with three evenly distributed pressure-balanced holes A corresponding to three s pressure-balanced holes B on the guide body.

In some other or further embodiments, the switch control cylinder is in clearance fit with or between the mandrel and the guide body respectively; the switch control cylinder is configured to slide along the axial direction, and is configured with a "W" shaped groove that works with the control screw on the guide body to drive or rotate the switch; and the control spring has the maximum compression stroke that is not less than the axial sliding distance of the switch control cylinder.

In another embodiment, the switch control cylinder is configured to couple with the switch, and to move axially relative to the switch and not to move circumferentially. The switch is configured with double layers in the axis direction with six holes G evenly distributed on each layer corresponding to the holes D on the guide body. An annular groove for assembling a sealing ring is configured around each hole G on the external cylindrical surface of the switch.

In some other or further embodiments, two pushing blocks may form an angle 120° in the circumferential direction, be limited by a pushing block cover (i.e., the cover plates) on the guide body, and can lengthen or contract in the cavity A. The pushing block one-way nozzle only allows fluid to flow out from cavity A.

In other embodiments, the pushing block one-way nozzle is connected to the pushing blocks by a threaded screw-type fitting on the outside of the nozzle housing; a section in the nozzle housing is configured with a thread (e.g., a threaded connector) corresponding to a nozzle inner baffle, and another section of the nozzle housing is configured with inner spline grooves having a minimum inner diameter equal to the external diameter of the nozzle valve cores. An external surface of the nozzle inner baffle is configured with some thread and with a hexagonal through hole smaller than the external diameter of the nozzle valve cores.

In another embodiment, the guide body is configured with two cavities A at an angle of 120° (e.g., for the pushing blocks) and a blade block evenly distributed on the circumference of the guide body (at an angle of 120° to the two cavities A), and three pressure-balanced holes C uniformly distributed at the position of the control spring; the mandrel is configured with a hole E and hole F for fluid to flow into the cavity B and the cavity A respectively; the upper end of the mandrel is connected with the test section as the upper joint of the tool by a threaded screw-type fitting, and the lower end of the mandrel is integrated with a lower joint.

In another embodiment, the upper and lower ends of the guide body are each configured with a pair of TC bearings; a TC bearing static ring is close to the upper and lower ends of the guide body; a plane bearing positioned by the TC bearing static ring and an adjusting nut; wherein the spring retainer, which may be clamped on the mandrel, is configured to prevent loosening of the adjusting nut.

In other or further embodiments, the stiffness value of the clutch spring is greater than that of the control spring, which ensures that: after the fluid pressure in the cavity B changes, when a force applied on the clutch control cylinder is not less than the force applied on the switch control cylinder, the switch control cylinder rotates down first, and then the clutch control cylinder slides to disengage.

The present invention shows the following benefits: it is a steering drilling tool controlled and/or performed purely mechanically, unlikely to fail in complicated and variable well environments. When it needs steering, what the operators need to do is: change the inner fluid pressure, adjust the tool facing the steering direction, then recover the fluid pressure. It is easily operated and no special training is required for operators. At the same time, there is no electronic device in the tool, which makes it stable and reliable as well as low-cost.

DRAWINGS

In the drawings, the same components use the same reference numbers, and the drawings are not drawn to actual scale.

Figure 1:
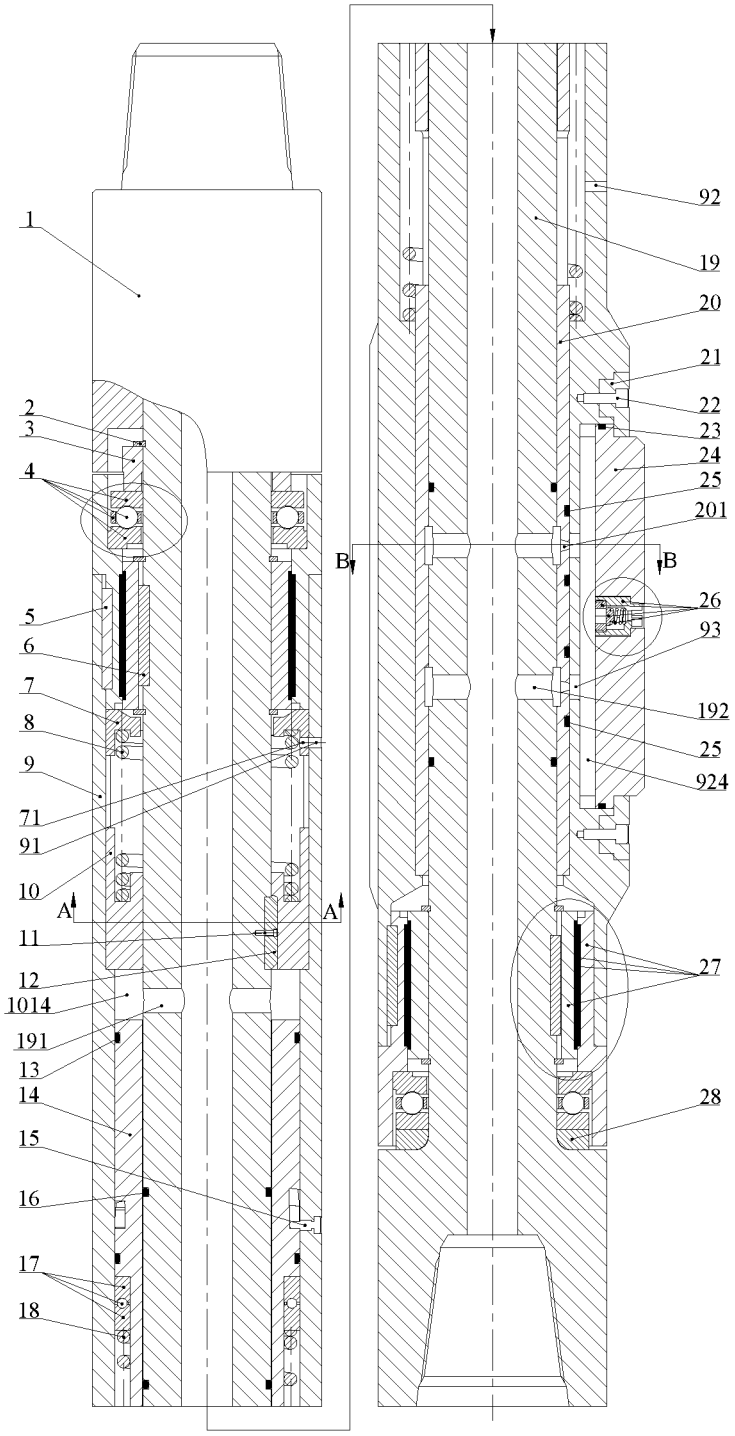
FIG. 1 illustrates an embodiment of a mechanical rotary steering drilling tool in the present invention.

The parts of the reference numbers in the drawings are as follows: 1—test section, 2—spring retainer, 3—adjusting nut, 4—thrust bearing, 41—thrust bearing retainer A, 42—ball cage, 43—ball, 44—thrust bearing retaining ring B, 5—flat key A, 6—flat key B, 7—Spring retainer, 71—hole A, 8—clutch spring, 9—guide body, 91—hole B, 92—hole C, 93—hole D, 924—cavity A, 10—clutch control barrel, 1014—cavity B, 11—clutch fixing screw, 12—clutch key, 13—seal ring A, 14—switch control cylinder, 15—control screw, 16—seal b, 17-thrust bearing, 18—control spring, 19—mandrel, 191—hole E, 192—hole F, 20—switch, 201—hole G, 21—push block cover plate, 22—cover plate screw, 23—seal ring C, 24—pushing block, 25—seal ring, 26—push block one-way nozzle, 261—nozzle shell, 262—nozzle inner baffle, 263—nozzle valve core, 264—nozzle spring, 27—TC bearing, 271—TC bearing static ring, 272—TC bearing static wear band, 273—TC bearing dynamic wear band, 274—TC bearing moving ring, 28—thrust bearing block ring.

EXAMPLES

The present invention will be further described in below examples referring to the drawings.

Embodiments disclosed herein relate to a mechanical rotary steering drilling tool used in various situations where steering drilling is required.

As shown in FIG. 1, a mechanical rotary steering drilling tool comprises a test section 1 having an inner part connected with a mandrel 19 by a threaded screw-type connection mechanism (not shown); the test section 1, used as an upper joint of the mechanical rotary steering drilling tool, is configured to test an azimuth angle, a tool face angle, and a well inclination angle, and to transmit relevant test data to an operator, etc. The mechanical rotary steering drilling tool further comprises a clutch device: the mandrel 19 and a guide body 9 are configured to rotate independently when the clutch device is disengaged, and to rotate together when it is engaged. The mechanical rotary steering drilling tool further comprises a control mechanism: a switch 20 driven by a switch control barrel 14 on the control mechanism is configured to rotate to open or close a hole D 93 on the guide body 9. The mechanical rotary steering drilling tool further comprises an execution part: a plurality of pushing blocks 24 on the execution part is configured to extend to apply a thrust against an external well wall.

When a steering drilling is required: first a drilling fluid pressure is decreased, reducing the drilling fluid pressure in cavity B 1014; a switch control cylinder 14 is reset by a control spring 18 and a clutch control cylinder 10 is reset by a clutch spring 8 to connect with a mandrel 19 and the guide body 9. A drill string is rotated by a ground turntable plate or a top drive to adjust the tool face angle of the mechanical rotary steering drilling tool. Thereafter, the drilling fluid pressure is restored, the drilling fluid pressure in the cavity B 1014 rises, which pushes the switch control cylinder 14 to rotate down and pushes the control switch 20 to rotate too, so as to build a fluid communication among a hole G 201 in the switch 20, a hole F 192 in the mandrel 19 and a hole 93 in the guide body 9. The hole G 201 at the switch 20 connects with the hole F 192 at the mandrel 19 and the hole D 93 on the guide body 9 so that the drilling fluid flows through the hole F 192, the hole G 201, and the hole D 93 to enter the cavities A 924, then the pushing block 24 extends and pushes against the well wall to generate a reaction force against the drill bit. The high-pressured drilling fluid in the cavity B 1014 pushes the clutch control barrel 10 to disengage the clutch device to steer the drilling. When the steering drilling is completed and it needs go back to normal drilling, the drilling fluid pressure is reduced first, the switch control cylinder 14 is reset again under the action of the control spring 18 down, then the drilling fluid pressure is restored to rotate the switch control cylinder 14 and move it down, then push and/or rotate the control switch 20 so as to block the channel between the hole F 192 in the mandrel and the hole D 93 in the guide body 9. The cavity A 924 is communicated to the wellbore annulus via a push-block one-way nozzle 26 to relieve pressure, and under the reaction of the well wall, the pushing blocks 24 retract to end the steering drilling process and resume normal drilling.

Figure 2:
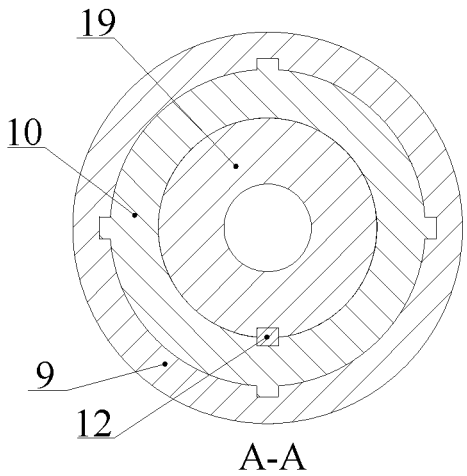
FIG. 2 illustrates an A-A cross-sectional view of the clutch device in FIG. 1.

In a preferred embodiment shown in FIGS. 1 and 2, four splines corresponding to the keyways disposed at the guide body 9 are uniformly distributed on the outside of the clutch control cylinder 10. The clutch control cylinder 10 is in clearance fit with the mandrel 19 and the spline groove on the guide body 9 from inside and outside, respectively. The clutch control cylinder 10 slides in the axial direction; the clutch device can be stationary or rotate together with the guide body 9; the sliding stroke of the clutch control cylinder 10 sliding in the axial direction and the maximum compression stroke of the clutch spring 8 are greater than the length of the clutch key 12 to ensure that the clutch device can be completely separated.

In some embodiments, only one clutch key 12 is present, and ends of the clutch key 12 are arc surfaces; the clutch control barrel 10 is configured with a key groove corresponding to the clutch key 12. Once the clutch device is engaged, the circumferential position of the mandrel 19, the clutch control barrel 10 and the guide body 9 is uniquely determined to be convenient for adjusting the tool face angle. The spring retainer 7 is configured with four splines evenly distributed on the outside corresponding to the inner splines on the guide body 9. Three evenly distributed pressure-balanced holes A 71 are on the spring retainer 7 corresponding to three pressure-balanced holes B 91 on the guide body 9 so that both ends of the clutch control cylinder 10 bear the pressure difference between the inside and outside of the tool, instead of the drill fluid pressure inside the tool, so as to ensure the rigidness of the clutch spring 8.

In a preferred example, the switch control cylinder 14, sliding in the axial direction, is in clearance fit with the mandrel 19 and the guide body 9 from inside and outside, respectively. The outer cylindrical surface of the switch control cylinder 14 is configured with a "W"-shaped groove which cooperates with the control screw 15 on the guide body 9 to drive the switch 20 to rotate. The maximum compression stroke of the control spring 18 is not less than the axial sliding distance of the switch control cylinder 14.

Further, the switch control cylinder 14 and the switch 20 are configured to couple with each other and may have a relative axial positional change, but not a relative circumferential position change, between each other. The switch control cylinder 14 has both rotary motion and axial motion while the switch 20 only retains the rotary motion. The switch 20 has six holes G 201 divided into two layers in axis direction, with three evenly distributed in each layer, corresponding to the holes D 93 on the guide body 9 to ensure that once the drilling fluid pressure is changed, and the status of the switch 20 changes accordingly. An annular groove around each hole G 201 is on the external cylindrical surface of the switch 20 to assemble a sealing ring 25 so as to turn on or off the switch 20 completely.

Figure 3:
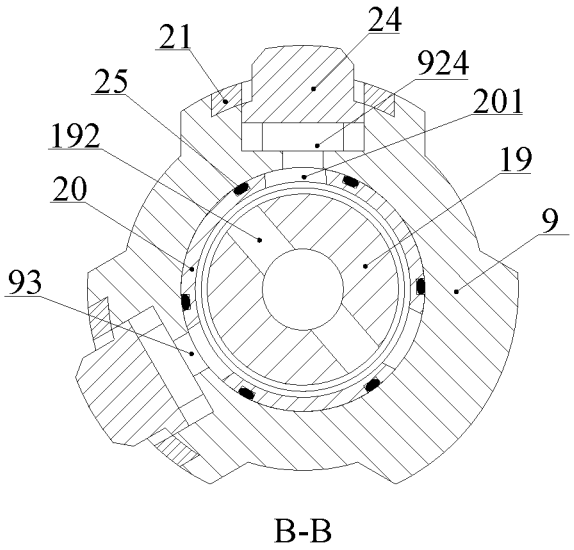
FIG. 3 shows a B-B sectional view of the execution part in FIG. 1.
Figure 4:
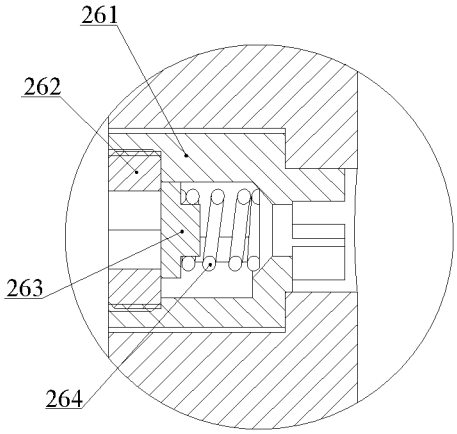
FIG. 4 illustrates an enlarged view of the one-way nozzle of the push block in FIG. 1.

In a preferred example shown in FIGS. 1 and 3, two pushing blocks 24 are on the guide body 9, spaced apart by 120° in the circumferential direction. The pushing block cover plates 21 restrict the expansion or contraction of the guide body 9 in the cavities A 924. The push block one-way nozzle 26 only allows fluid to flow out from the cavities A 924, and restricts the fluid to flow into the cavities A 924:

Further, as shown in FIGS. 1 and 4, the push block one-way nozzle 26 is connected to the pushing block 24 by a threaded screw-type fitting on the outside of the nozzle housing 261. Some inner section of the nozzle housing 261 is configured with an internal screw thread corresponding to the external screw thread at the nozzle inner baffle 262. The minimum inner diameter of the inner spline groove on the other section of nozzle housing 261 is equal to the outer diameter of the nozzle valve cores 263; an inner hexagonal through hole in the middle of the nozzle inner baffle 262 is smaller than the outer diameter of the nozzle valve cores 263, and is configured for flowing fluid and tightening or relaxing the nozzle inner baffle 262.

As shown in FIGS. 1 and 3, the guide body 9 includes two cavities A 924 and a blade block with a difference angle of 120° on its circumference. The two cavities A 924 are configured to house the pushing blocks 24. The guide body 9 has three uniformly distributed pressure-balanced holes C 92 at the position where the control spring 18 is assembled so that the two ends of the switch control cylinder 14 bear the pressure difference between the inside and the outside of the tool instead of the drilling fluid pressure inside the tool so as to ensure the rigidness of the spring 18. The mandrel 19 is configured with a hole B 191 for fluid into the cavity B 1014 and a hole F 192 for fluid into the cavities A 924, respectively. The upper end of the mandrel 19 is connected with the test section 1 as the upper joint by a threaded screw-type fitting, and the lower end of the mandrel 19 is integrated with the lower joint, which ensures that when the tool is assembled, the connecting screw thread of the test section 1 transfers torque to the mandrel 19.

Figure 5:
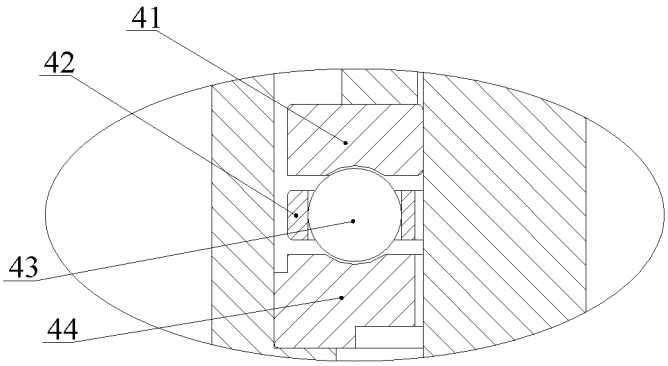
FIG. 5 illustrates an enlarged view of the thrust bearing in FIG. 1.
Figure 6:
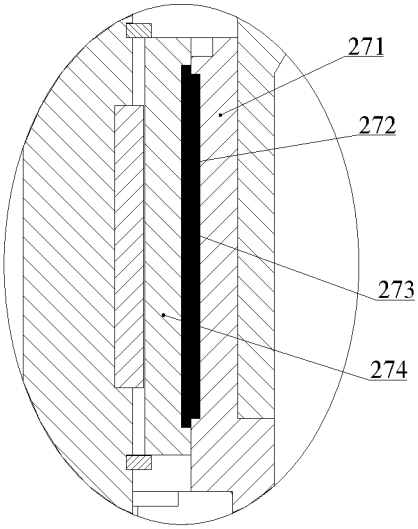
FIG. 6 illustrates an enlarged view of the TC bearing in FIG. 1.

As shown in FIGS. 1, 4, and 5, a pair of TC bearings 27 at the upper and lower ends of the guide body 9 are configured to withstand the radial force generated by the pushing blocks 24 pushing against the well wall. A TC bearing static ring 271 near the two end faces of the tool is configured with a plane bearing 4, axially positioned by the TC bearing static ring 271 and the adjusting nut 3 to bear the axial force. Wherein, the adjusting nut 3 uses the spring retainer 2 clamped on the mandrel 19 to prevent loosening so as to avoid the loosening of the adjusting nut 3 failing to axial limit the plane bearing 4 due to the vibration of the tool during the working process.

In a preferred embodiment, the stiffness value of the clutch spring 8 is greater than the stiffness value of the control spring 18, which ensures that: when the fluid pressure in the cavity B 1014 changes, a reaction force on the clutch control cylinder 10 is not less than that on the switch control cylinder 14, wherein the switch control cylinder 14 first rotates down, and then the clutch control cylinder 10 slides to disengage.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements may be devised without departing from the spirit and scope of the described technology. The present invention is not limited to the specific embodiments disclosed in the text, but includes all technical solutions falling within the scope of the claims.

What is claimed is:

1. A mechanical rotary steering drilling tool comprising: a test section, a mandrel having a keyway, a clutch device, a guide body, a control mechanism, an execution part, a plane bearing, a tungsten carbide (TC) bearing, and first and second ends, the first end being connectable with an upper drilling tool by a first detachable screw thread, and the second end being connectable with a bit by a second detachable screw thread; wherein:

the test section serves as an upper joint of the mechanical rotary steering drilling tool, and the test section comprises an inner part connected with the mandrel;

the clutch device includes a spring retainer axially positioned by a TC bearing static ring, a clutch key in the keyway of the mandrel, a clutch fixing screw that fixes the clutch key, a clutch control barrel connecting the mandrel and the guide body, and a clutch spring between the spring retainer and the clutch key; wherein the mandrel and the guide body rotate independently of each other when the clutch device is disengaged, but the mandrel and the guide body rotate together when the clutch device is engaged;

the control mechanism includes a switch control cylinder that converts axial movement into rotational movement, a screw on the guide body configured to limit an axial displacement of the switch control cylinder, a control spring that resets the switch control cylinder, and a switch driven by the switch control cylinder, the switch being configured to open or close a plurality of holes;

the execution part includes a plurality of pushing blocks in first cavities on the guide body, a plurality of cover plates configured to limit a radial stroke of the pushing blocks, a plurality of cover plate screws configured to fix the cover plates, and a plurality of pushing block one-way nozzles configured to allow single direction communication; wherein the pushing blocks are configured to exert a pushing force on an external wall.

2. The mechanical rotary steering drilling tool as in claim 1, wherein the clutch control cylinder has four evenly distributed splines corresponding to the keyway configured inside the guide body; the clutch control cylinder is in clearance fit with the mandrel and the splines of the clutch control cylinder is in clearance fit with the keyway; the clutch control cylinder is configured to slide in an axial direction; and the clutch spring has a maximum compression stroke greater than a length of the clutch key.

3. The mechanical rotary steering drilling tool as in claim 1, containing only one clutch key, and the one clutch key has ends that are arc surfaces; the mechanical rotary steering drilling tool contains a plurality of the keyways inside the clutch control cylinder and corresponding to and/or matching the one clutch key; the spring retainer is configured with four splines on an outside of the spring retainer and corresponding to the plurality of the keyways, and containing three first pressure-balanced holes and three second pressure-balanced holes on the guide body, wherein the three first pressure-balanced holes are evenly distributed and correspond to the three second pressure-balanced holes.

4. The mechanical rotary steering drilling tool as in claim 1, wherein the switch control cylinder is in clearance fit with the mandrel and the guide body; the switch control cylinder has an outer surface able to slide along the axial direction and configured with a "W" shaped groove that cooperates with the control screw to drive the switch; and the control spring has a maximum compression stroke that is not less than an axial sliding distance of the switch control cylinder.

5. The mechanical rotary steering drilling tool as in claim 1, wherein the switch control cylinder is coupled with the switch; and the switch includes two layers, six holes evenly distributed in each of the two layers, the six holes corresponding to the plurality of holes on the guide body in an axis direction, and an annular groove around each of the six holes in an outer surface of the switch, configured to receive a sealing ring.

6. The mechanical rotary steering drilling tool as in claim 1, wherein two of the pushing blocks are configured at a 120° angle in a circumferential direction of the guide body, the cover plates are configured to limit movement of the pushing blocks in the first cavities; and the pushing block one-way nozzles are configured to allow fluid to flow only out from the first cavities.

7. The mechanical rotary steering drilling tool as in claim 6, wherein each of the pushing block one-way nozzles have a housing with an outer surface, and the pushing block one-way nozzles are connected to respective ones of the pushing blocks by a threaded screw-type fitting on the outer surface of the housing; each of the pushing block one-way nozzles have an inner baffle, inner spline grooves on the housing, and a valve core with an outer diameter; the inner spline grooves have a minimum inner diameter equal to the outer diameter of the valve cores; the inner baffle has an external surface with a hexagonal through hole smaller than the outer diameter of the valve core.

8. The mechanical rotary steering drilling tool as in claim 1, wherein two of the first cavities are at a 120° angle, the mechanical rotary steering drilling tool further comprises a blade block at a 120° angle with respect to the two first cavities, and three third pressure-balanced holes uniformly distributed at a position of the control spring; the mandrel is configured with a first hole and a second hole for fluid to flow into a second cavity and the first cavities, respectively; the mandrel has an upper end connected with the test section, and a lower end integrated with a lower joint.

9. The mechanical rotary steering drilling tool as in claim 1, wherein the guide body has (i) an upper end configured with the TC bearing and the TC bearing static ring and (ii) a lower end configured with another TC bearing and another TC bearing static ring; the mechanical rotary steering drilling tool further comprises a plane bearing positioned by one of the TC bearing static rings and an adjusting nut; wherein the spring retainer is configured to prevent loosening of the adjusting nut.

10. The mechanical rotary steering drilling tool as in claim 1, wherein the clutch spring has a stiffness value that is greater than that of the control spring.

* * * * *